US010849466B2

(12) United States Patent
Robinson

(10) Patent No.: US 10,849,466 B2
(45) Date of Patent: Dec. 1, 2020

(54) FLEXIBLE SEALING MEMBER

(71) Applicant: Sealux Limited, Dublin (IE)

(72) Inventor: Gerard Francis Robinson, Dublin (IE)

(73) Assignee: SEALUX LIMITED, Dublin (IE)

( * ) Notice: Subject to any disclaimer, the term of this patent is extended or adjusted under 35 U.S.C. 154(b) by 587 days.

(21) Appl. No.: 14/913,192

(22) PCT Filed: Aug. 21, 2014

(86) PCT No.: PCT/EP2014/067827
§ 371 (c)(1),
(2) Date: Feb. 19, 2016

(87) PCT Pub. No.: WO2015/024998
PCT Pub. Date: Feb. 26, 2015

(65) Prior Publication Data

US 2016/0198907 A1 Jul. 14, 2016

(30) Foreign Application Priority Data

Aug. 21, 2013 (GB) ..... 1314947.1
Sep. 4, 2013 (GB) ..... 1315731.8

(51) Int. Cl.
*A47K 3/00* (2006.01)
*E04F 19/04* (2006.01)
*E04B 1/66* (2006.01)

(52) U.S. Cl.
CPC ..... *A47K 3/008* (2013.01); *E04B 1/665* (2013.01); *E04F 19/0477* (2013.01)

(58) Field of Classification Search
CPC ..... A47K 3/008; B32B 2405/00; B32B 2419/00; E04B 1/64; E04B 1/66;
(Continued)

(56) References Cited

U.S. PATENT DOCUMENTS 6,868,643 B1 * 3/2005 Williams ..... E04B 1/70 52/169.14
7,100,331 B2 * 9/2006 Nehring ..... A47K 3/008 52/13

(Continued)

FOREIGN PATENT DOCUMENTS

EP 2405067 1/2012
FR 2914548 10/2008

(Continued)

OTHER PUBLICATIONS

Written Opinion of ISA for corresponding PCT application PCT/EP2014/067827, dated Apr. 12, 2014, 8 pp.

(Continued)

*Primary Examiner* — Scott R. Walshon
(74) *Attorney, Agent, or Firm* — Caseiro Burke LLC; Chris A. Caseiro

(57) ABSTRACT

A sealing system (10) comprises of a flexible strip (11) having an upper boundary (12) and a lower boundary (13) an inner face (14) and an outer face (15). The inner face (14) has an upper region (16) and a lower region (17). The outer face (15) has an upper region (18) and a lower region (19). The strip inner face (14) and outer face (15) is coated with a film that allows tenacious adhesion between the strip (11) and an adhesive material.

33 Claims, 7 Drawing Sheets

(58) Field of Classification Search
CPC ..... E04B 1/665; E04B 1/68; E04F 19/045; E04F 19/0459; E04F 19/0477; E03F 5/0408
See application file for complete search history.

(56) References Cited

U.S. PATENT DOCUMENTS

| | | | | |
|---|---|---|---|---|
| 2003/0175482 | A1* | 9/2003 | Porter | A47K 3/008 428/172 |
| 2006/0141247 | A1* | 6/2006 | Bohm | B32B 7/12 428/343 |
| 2008/0105363 | A1* | 5/2008 | Ford | B32B 37/203 156/153 |
| 2010/0325969 | A1* | 12/2010 | Hourihan | A47K 3/008 52/35 |
| 2014/0093689 | A1* | 4/2014 | Amundson | B29C 48/21 428/156 |

FOREIGN PATENT DOCUMENTS

| | | | | |
|---|---|---|---|---|
| GB | 2337565 | A * | 11/1999 | A47K 3/008 |
| GB | 2364555 | | 1/2002 | |
| GB | 2445917 | | 7/2008 | |
| GB | 2467390 | A * | 8/2010 | A47K 3/008 |
| GB | 2488627 | | 9/2012 | |
| GB | 2491919 | | 12/2012 | |
| WO | 2000/014350 | | 3/2000 | |
| WO | 2004030506 | | 4/2004 | |
| WO | 2012/116988 | | 9/2012 | |

OTHER PUBLICATIONS

International Preliminary Report on Patentability for corresponding PCT application PCT/EP2014/067827, dated Nov. 6 2015, 24 pp.
Machine translation into English of disclosure for Foreign Patent Document #2, 7 pp.
Machine translation into English of claims for Foreign Patent Document #2, 2 pp.
Search report of priority GB application GB1314947.1, dated Feb. 27, 2014, 1 pp.
Machine translation into English of disclosure for Foreign Patent Document #6, 23 pp.
Machine translation into English of claims for Foreign Patent Document #6, 5 pp.
Search report of priority GB application GB1315731.8, dated Aug. 21, 2014, 6 pp.

* cited by examiner

Figure 1
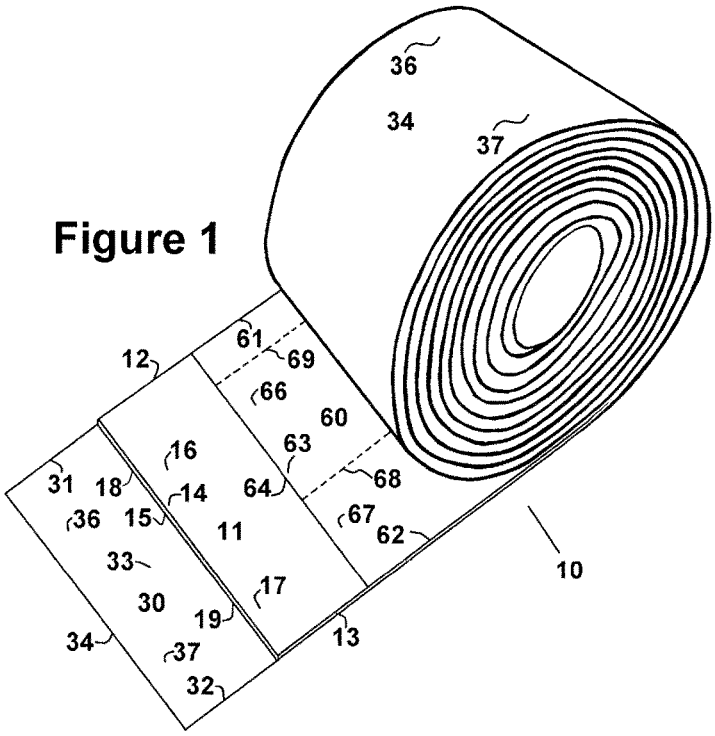
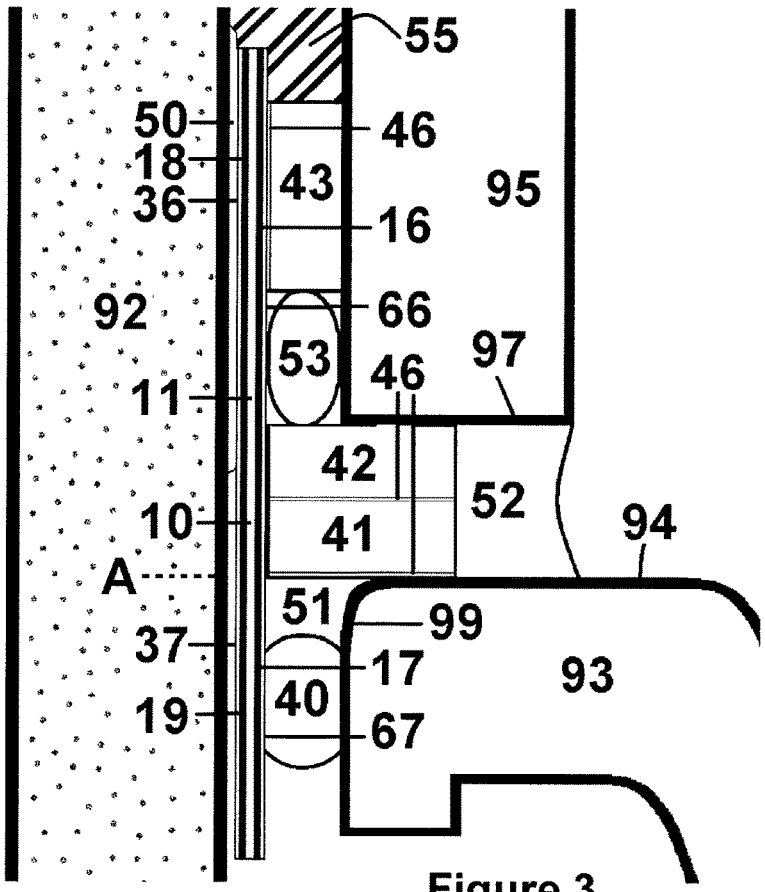
Figure 3
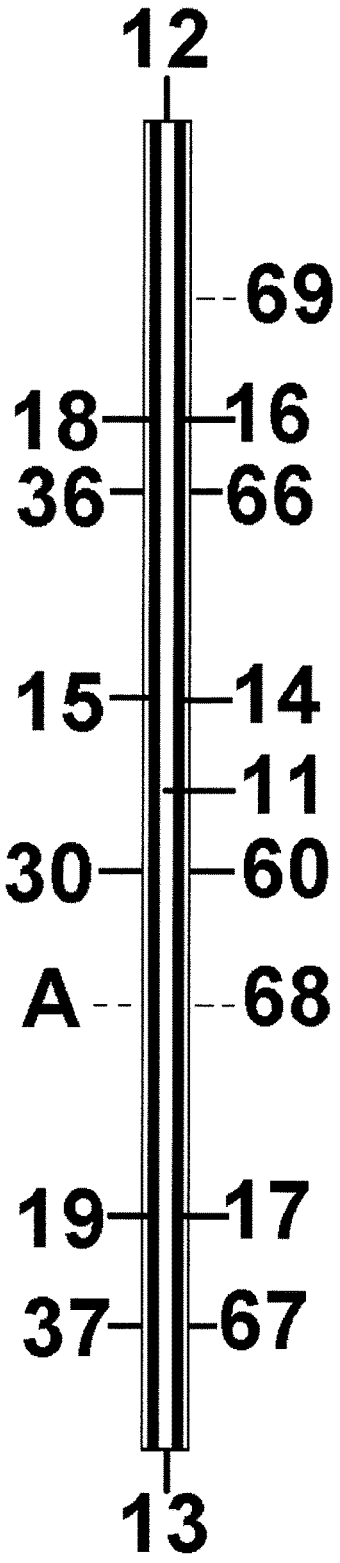
Figure 2

Figure 7
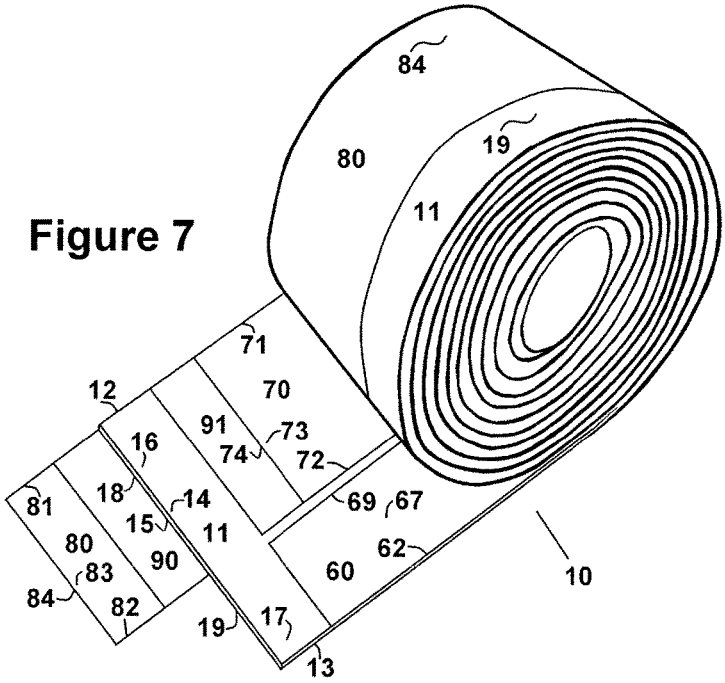
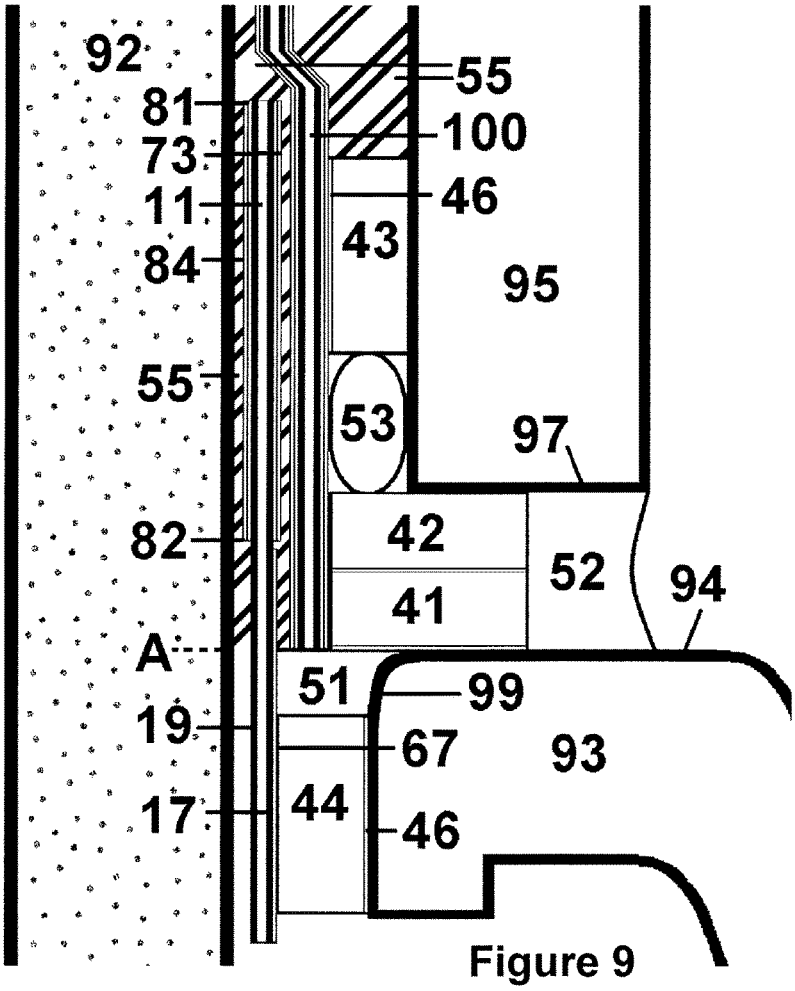
Figure 9
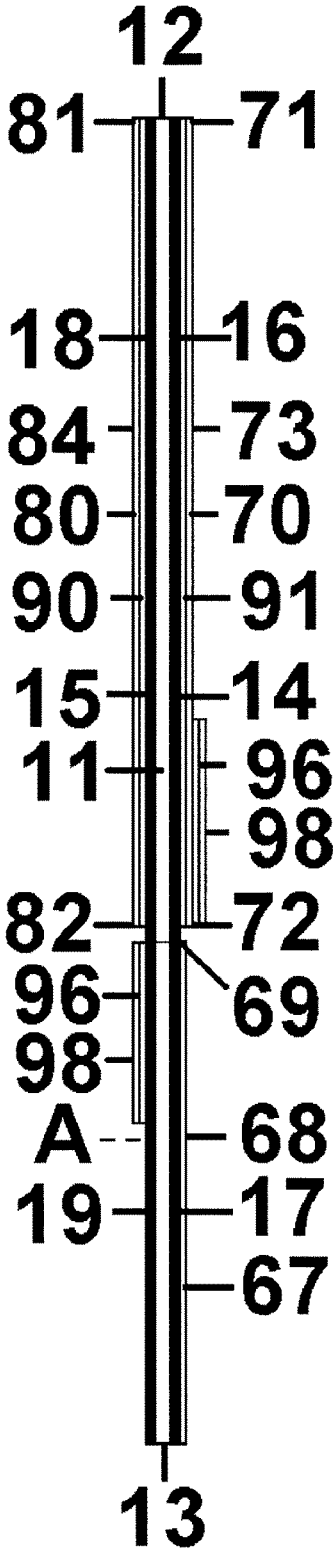
Figure 8

Figure 13
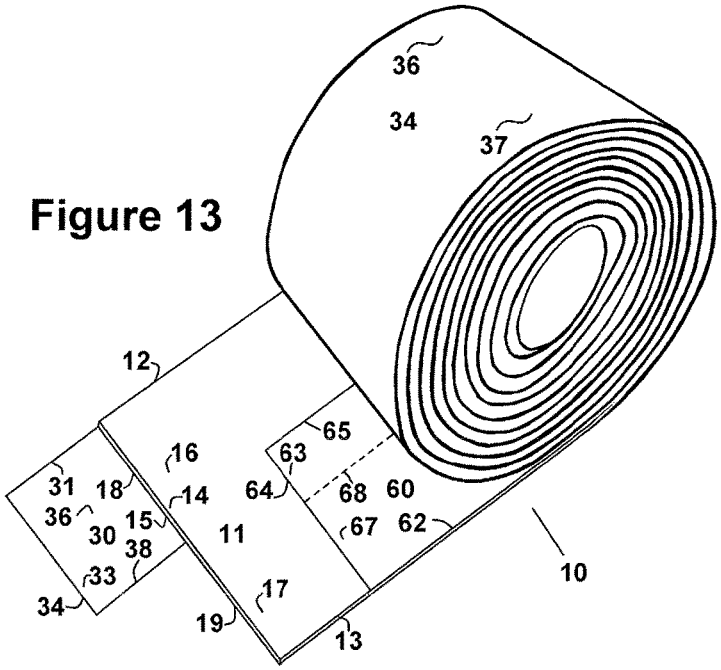
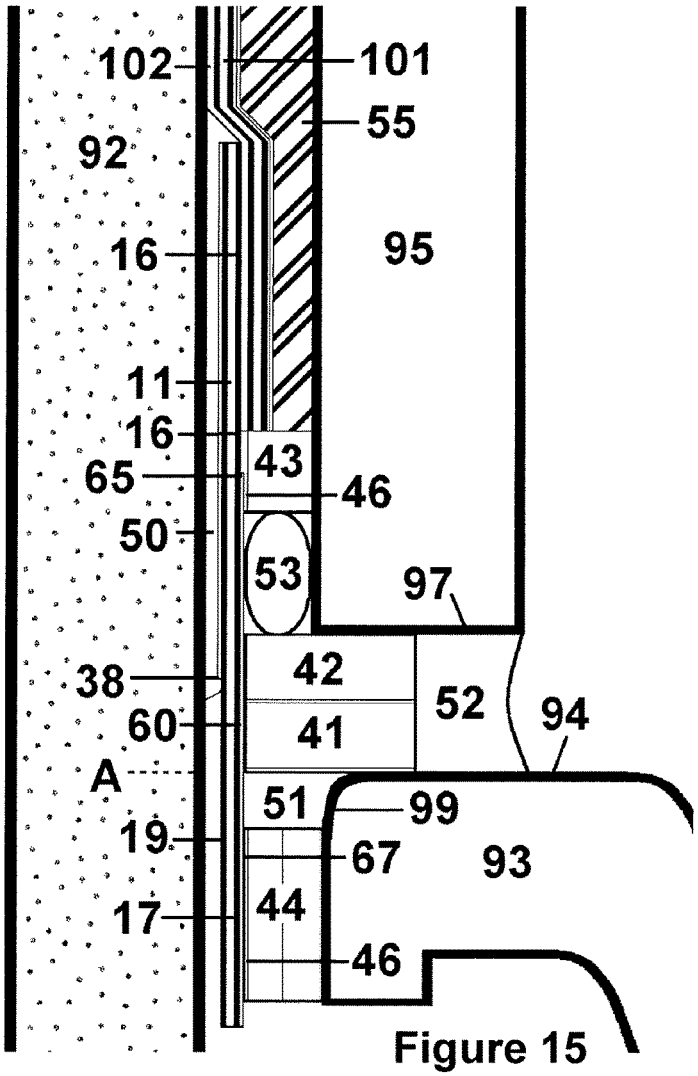
Figure 15
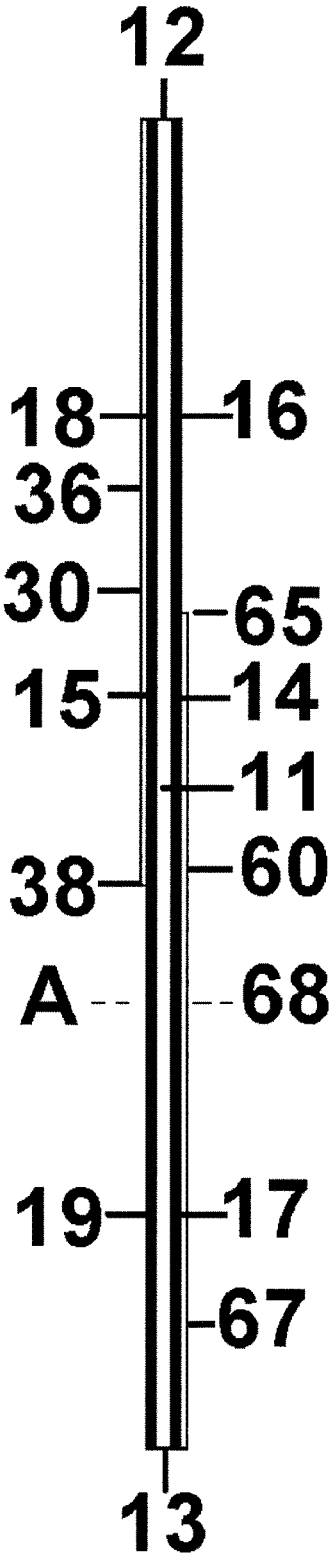
Figure 14

FLEXIBLE SEALING MEMBER

BACKGROUND OF THE INVENTION

The present invention relates to a sealing member adapted to be installed independently or as a component of a sealing system to create a watertight barrier over substrates exposed to moisture in the shower environment and maintain a waterproof joint seal connection between two or more such substrates disposed in line or at an angle to each other such as the joint between a wall and the adjacent perimeter side wall/ledge of a shower tray or bath.

DESCRIPTION OF THE PRIOR ART

Relevant prior art relating to traditional sealing systems adapted to seal the joint between a shower tray and adjacent wall feature a strip membrane with a high tack butyl or pressure sensitive foam adhesive tape longitudinally applied to a lower portion of one side. During installation the adhesive strip is exposed and bonded to the shower tray perimeter side wall before installation of the tray against the intended shower wall.

A known problem with such pre-assembled up-stand strips is that shower tray perimeter side wall corners are usually rounded whereas the corners of meeting walls into which they are located are usually 90 degrees. A rounded shower tray corner located into a 90 degree wall corner junction creates a triangular void. When the up-stand strip is bonded around these shower tray corners, the upper portion of the up-stand strip (above the ledge) cannot extend into the wall corner because it is to short. Installers are instructed to pinch, pleat or bulk up the butyl adhesive at corners to elongate the length of the up-stand.

Another problem with butyl adhesive and elastomeric materials is that after installation they can react aggressively with sealant.

Up-stand strips of the type described must be installed before the shower tray or bath is fitted. This not only restricts the installation opportunity but creates confusion in respect of which trade is responsible for the installation. Most frequently, it is the plumber who connects the up-stand strip to the receptacle and it is the tiler who connects the up-stand strip to the wall. The problem arises as to who is responsible if the joint leaks.

Membranes of polyethylene or polypropylene onto which are glued a fleece layer for mechanical adhesion to tile adhesive are a proven means of waterproofing walls and floors. Such material is available in narrow widths of typically 100 mm and used as up-stand strips to seal around shower trays and baths.

While the roughened membrane fleece texture is ideal for gripping tile adhesive it is not ideally suited to sealant. The tile adhesive used to overlap fleeced wall membranes with fleeced up-stand strips can cause a build up material liable to deflect the adjacent tile.

SUMMARY OF THE INVENTION

It is the object of this invention to limit or eliminate the aforementioned problems associated with prior art up-stand seals.

According to the present invention there is provided a sealing member adapted to be installed independently or as a component of a sealing system to create a watertight barrier over substrates exposed to moisture in the shower environment and maintain a waterproof joint seal connection between two or more such substrates disposed in line or at an angle to each other such as the joint between a wall and the adjacent perimeter side wall/ledge of a shower tray or bath, in the installed orientation comprising of: a flexible longitudinal strip having a strip upper boundary and a strip lower boundary between which strip boundaries there extends a strip inner face and a strip outer face which strip outer face has a strip outer face upper region and a strip outer face lower region and which strip inner face has a strip inner face upper region and a strip inner face lower region: characterized in that the strip is adapted to provide a means of tenacious engagement between the strip and an adhesive material.

Preferably, the strip performs in combination with an adhesive material that is a sealant adhesive material of the type that may be extruded uncured from a tube, applied as desired and thereafter cure as a bonding material or a joint sealing material or both.

Ideally, the strip is a flexible polymeric material such as polyethylene or polypropylene in type.

Preferably, the means of tenacious engagement between the strip and an adhesive material is achieved through a roughening of part or whole strip surface.

Ideally, a means of tenacious engagement between the strip and an adhesive material is typically achieved through the plasma/corona etching of part or whole strip surface.

Preferably, means of tenacious engagement between the strip and an adhesive material is typically achieved through the provision of laminated film coated onto part or whole strip surface.

Preferably, the laminated film is typically a silicone based liquid plasma/corona etched into the strip and cured.

Ideally, one or more parts of the strip are both etched and laminated with a silicone film.

Preferably, the adhesive material is silicone based and tenaciously bondable to a silicone film.

Ideally, the visibility of the laminated film region of the strip is highlighted through the incorporation of a dye or dyelines onto or into said region.

Advantageously, the laminated film also provides a releasable engagement with preformed high tack adhesive strips.

In one embodiment, the laminated film extends over the entire strip inner face or over the entire strip outer face or both faces simultaneously.

In another embodiment, the laminated film extends in one or more longitudinal strips over the strip inner face or over the strip outer face or over both faces simultaneously.

Ideally, one or more strip ledge lines extend longitudinally parallel on the up-stand strip.

Ideally, one or more strip trimming lines extend longitudinally parallel on the up-stand strip.

Preferably, said longitudinal strip trimming line is a perforated trimming line or such material weakness that would accommodate partitioning the strip by way of tearing.

In another embodiment, the strip is partially laminated with fleece through use of a glue bed as a means of providing non-releasable engagement between the strip and fleece and a non-releasable engagement between the strip and a tile adhesive.

Ideally, the laminated fleece extends in one or more longitudinal strips over the strip inner face or over the strip outer face or over both faces simultaneously.

In another embodiment, the laminated film extends longitudinally over the strip inner face lower region and the laminated fleece extends over the strip inner face upper region and over the strip outer face upper region.

Advantageously, an isolating membrane may be pre-applied to extend longitudinally on the strip by way of pressure sensitive glue.

Preferably, a sealant isolating membrane may be pre-applied to extend longitudinally on the strip.

Alternatively, a isolating membrane may extend longitudinally on the strip inner face and said isolating membrane may be siliconized and removable to expose adjacent pressure sensitive glue bonded to strip to form an adhesive bed on which may be bonded a backer material as a means of fixing the position of the wall tile adhesive lower most boundary to limit or prevent the effects of capillary action.

In another embodiment, a isolating membrane may be siliconized and together with adjacent pressure sensitive glue may extend longitudinally over a portion of laminated film in which circumstances the isolating membrane with attached pressure sensitive glue would combine to form an adhesive transfer tape wholly releasable off the strip portion to which attached.

Ideally, said isolating membrane with attached pressure sensitive glue would combine to form an adhesive transfer tape longitudinally located between perforated trimming line and the strip lower boundary.

In another embodiment, the isolating membrane may extend longitudinally on the strip outer face and said sealant isolating membrane may be siliconized and removable to expose an adjacent pressure sensitive glue to provide a preliminarily means of part engagement of the strip outer face with the wall in preparation for the subsequent application of a permanent adhesive bed to facilitate a permanent engagement of the opposing strip outer face or desired part thereof with the wall.

In another embodiment, the strip is layered with a high tack adhesive.

Ideally, the high tack adhesive bonded to the strip outer face or parts thereof provides an engagement between strip outer face and the adjacent surface to which applied and which high tack adhesive may engage the strip inner face laminate film when said strip is rolled for transport and which high tack adhesive may readily release off the strip inner face laminate film when the said strip is unrolled for installation.

Preferably, the strip, laminated film and sealant adhesive materials are combined with a flexible compressible acoustic insulating sealant backing material.

Ideally, the backing material is a longitudinal circular strip.

Alternatively, the backing material is a longitudinal four sided strip wherein at least one side may be coated with a pressure sensitive adhesive and said backing material is supplied in roll format.

In another embodiment, the strip is supplied with backing material pre-applied.

Ideally, the strip may be longitudinally folded into connected strip layers each layer adapted to engage separate, opposing and adjacent joint substrates and provide gusset type flexibility.

In another embodiment said gusset type flexibility is longitudinally provided by means of pleat to accommodate stress free transverse elongation of the strip after strip installation between a shower tray or bath ledge and adjacent tile bottom edge.

The invention will hereinafter be more particularly described with reference to the accompanying drawings, which show by way of example only, some embodiments of the seal according to the invention:

BRIEF DESCRIPTION OF THE DRAWINGS

In the drawings:

FIG. 1 represents a perspective peel back view of the current invention 10 in roll form, detailing strip 11 wholly etched/laminated on each side with films 30 and 60;

FIG. 2 represents a section view of FIG. 1 but in an upright position in an installed orientation;

FIG. 3 represents a section view of the current invention as detailed in FIG. 2, after installation between a shower tray 93 and adjacent tiled 95 wall 92;

FIG. 7 represents a perspective peel back view of the current invention 10 in roll form, detailing strip 11 partially layered on both sides with hydrophobic non-woven fleece 80 and 70 through adhesive layers 90 and 91 respectively and partially laminated with film 60 on side 14;

FIG. 8 represents a section view of FIG. 7 but in an upright position in an installed orientation with a sealant isolation membrane 98 applied;

FIG. 9 represents a section view of the current invention as detailed in FIG. 8, after installation between a shower tray 93 and adjacent adhesive 55 tiled 95 wall 92 and wherein strip 11 is overlapped by waterproof wall membrane 100;

FIG. 13 represents a perspective peel back view of the current invention 10 in roll form, detailing strip 11 partially etched/laminated with film 67 on side 14 and partially etched/laminated with film 36 on side 15;

FIG. 14 represents a section view of FIG. 13 but in an upright position in an installed orientation;

FIG. 15 represents a section view of the current invention as detailed in FIG. 14, after installation between a shower tray 93 and adjacent tiled wall 92;

In FIGS. 1-18 the strip is adapted for installation against a wall in a substantially vertical orientation over a shower tray or bath, the term 'inner face' should be understood to define a material surface facing the shower tray or bath after installation and the term 'outer face' should be understood to define a surface material facing the wall after installation.

DETAILED DESCRIPTION OF THE INVENTION

Figure 4:
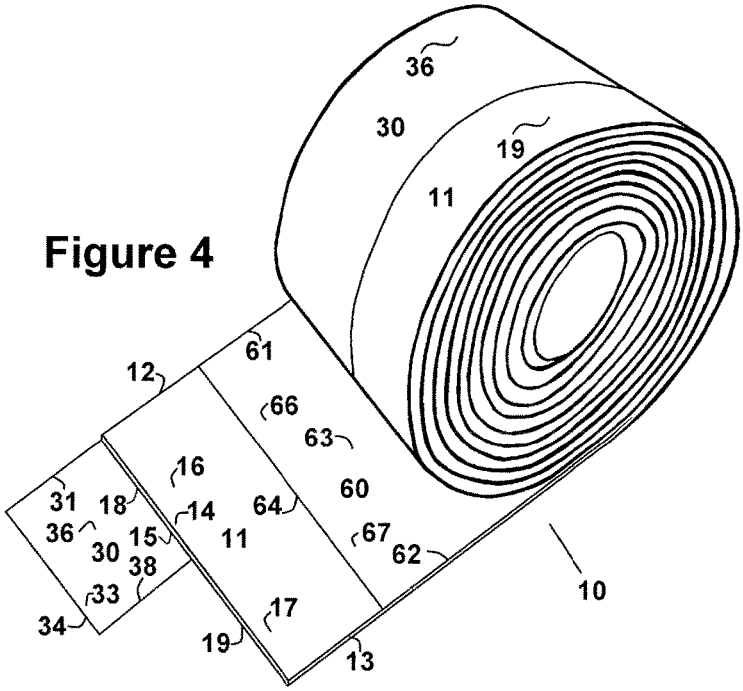
FIG. 4 represents a perspective peel back view of the current invention 10 in roll form, detailing strip 11 etched/laminated with film 60 on one side 14 and partially etched/laminated with film 30 on the opposite side 15.

Referring firstly to FIGS. 1 and 2 of the drawings, the sealing system 10 comprises a first component being flexible strip 11 which has strip upper boundary 12 and a strip lower boundary 13 between which strip boundaries there extends a strip inner face 14 and a strip outer face 15. The strip inner face 14 comprises of a strip inner face upper region 16 and a strip inner face lower region 17. The strip outer face 15 comprises a strip outer face upper region 18 and a strip outer face lower region 19. Typically but not exclusively, the strip 11 is a soft polyethylene or polypropylene type material.

Strip 11 inner 14 and outer faces 15 are wholly laminated films 60 and 30 respectively. This laminate is a flexible cured silicone based liquid plasma/corona etched into the strip. It should be understood that references to the location of laminated film(s) (or film laminated areas) detailed herein should also be understood to identify the location of plasma/corona etched areas of the strip 11. Laminated films 60 and 30 have their respective upper boundaries 61 and 31, lower boundaries 62 and 32, inner faces 63 and 33, outer faces 64 and 34, upper regions 66 and 36 and lower regions 67 and 37.

It should also be understood that whole or partial film lamination of strip 11 could be also achieved through multiple strip layering of film laminated material. Though not shown, it is intended that this means would fall within the scope of this invention.

A ledge line 68 may extend longitudinally on the strip inner face 14 to guide installers as to where the strip should be fixed on the wall. This height of this ledge 68 line above the floor should match the height of the ledge 94 above the floor shown as level A in the drawings.

A strip trimming line 69 may extend longitudinally on the strip to act as a cutting guide should installers wish to trim the height of the strip to suit the application. A perforated trimming line 69 would serve as a cutting guide to accommodate partitioning the strip through a tearing means.

FIG. 3 discloses the strip 11 in FIG. 2 installed between a wall 92 and shower tray 93. To install in accordance with FIG. 3 before the shower tray is located in its final position, the strip 11 is bonded to the wall 92 using a sealant adhesive 50 keeping the ledge line 68 on the strip level with proposed level of the tray ledge 94 and shown as A in the drawing.

Alternatively, the strip 11 can be retrospectively lowered into the joint between the wall 92 and the installed perimeter side wall of the shower tray 99 and bonded to the wall 92 with sealant adhesive 50. In this scenario the plumber is instructed to leave a gap of typically 5-7 mm between the wall 92 and perimeter side wall of the shower tray 99.

With the tray 93 installed adjacently to the strip 11, the shower tray perimeter side wall 99 and ledge 94 are cleaned with alcohol wipes to ensure good adhesion with sealant adhesive 51. A compressible backing material 40 is squeezed into the joint between the wall 92 and tray perimeter side wall 99.

Alternatively, the circular backing material 40 shown could be a four sided adhesive laminated closed cell backing material 44 as shown in FIG. 9 bonded onto the shower tray perimeter side wall 99 by the plumber before locating the shower tray 93 against the strip inner face lower region 17. The backing material could be a single layer or double layer as required to accommodate the varying or desired joint widths.

Alternatively, the aforementioned backing material 44 could be bonded to the strip before the shower tray 93 is installed. To facilitate this scenario one or more parallel lines may be provided on the strip inner face to guide installers during the process of aligning the adhesive laminated backing material on the strip inner face 14 prior to adhesive engagement. Such a single or double face adhesive laminated backing material may be supplied in roll format with or without a removable protective liner.

Alternatively, close celled backing material may be bonded to both the strip 11 and perimeter side wall 99 with adhesive sealant to also form a secondary joint seal below sealant 51. Strip 11 may alternatively be supplied to the installer with one or more backing materials of type 44 already pre-applied on the strip inner face 14

The backing material 40 or 44 should be located so as to ensure the adhesive sealant 51 will remain dimensionally flexible under the shear force it may be subjected to if the ledge 94 settles down. Backing material 40 or 44 should be ideally positioned so the depth of sealant adhesive 51 between the level of the ledge 94 and uppermost surface of the backing material 40 or 44 is typically 50% of the sealant adhesive 51 width between the up-stand strip inner face 17 and adjacent shower tray perimeter side wall 99.

To complete the joint sealing task, sealant adhesive 51 is extruded over the backing material 40 or 44 to fill the joint and is then rubbed up level with the ledge 94. Joint width variations are not problematic as sealant adhesive 51 is uncured. In this joint sealing installation method the tiler is responsible for waterproofing the joint.

Before tiling commences, the tiler fixes backing material 43 on the strip to shutter sealant adhesive 53 from tile adhesive 55. Sealant adhesive 53 is applied between the strip 11 and adjacent tile 95 to prevent moisture soakage back up between the tile 95 and wall 92 through capillary action. The backing materials 42 and 41 are bonded together through their adhesive bed 46 to create the desired dimension for the sealant adhesive 52 applied into the joint between bottom edge of the tile 97 and adjacent ledge 94 after tile installation.

The section profile, density and location of backing materials referred to herein also incorporates a consideration for the necessary acoustic damp proofing required to limit the noise generated through shower usage.

It should be understood that the sealant adhesives 50, 51 and 53 would not bond with strip 11 without the etched surfaces that create the mechanical bonding mechanism for the laminated films 60 and 30 to the strip 11 that in turn accommodate a tenacious adhesive bond with sealant adhesive, because strip 11 being of polyethylene or polypropylene polymeric type material has a low energy surface that naturally tends to repel rather than attract adhesives reliant on wetting for adhesion.

Through the etching and application of laminate films 60 and 30 onto the strip inner and outer faces 14 and 15 respectively, the adhesive sealants 50, 51 and 53 can form tenaciously strong adhesive bonds with said etched/film laminated portions of strip 11. Even when silicone sealant is hard pressed between a fleece laminated polyethylene or polypropylene strip and film laminated polyethylene or polypropylene strip of the type disclosed herein, comparative peel test wherein the bonded strips are peeled apart indicate the sealant 50, 51/film 60, 30/strip 11 bond is much stronger than the equivalent sealant 50, 51/fleece 70, 80/strip bond.

It should also be understood that etching the strip in itself will enhance strip bondability with sealant adhesive. A down side of plasma/corona etching is the effective shelf life wherein the potential 'bond tenacity' created through etching the strip diminishes with age due to molecular realignment. The prompt application and curing of laminate films 60 and 30 over the relatively freshly etched surfaces during the siliconization process is firstly an advantageous means of prolonging the shelf life and secondly a compatible means of providing a base film that a silicone based adhesive will tenaciously adhere to.

Installing the strip 11 to the wall 92 as a separate component of the sealing system allows the strip 11 without restriction to extend fully into and around 90 degree wall corner junctions. This approach to the product design and installation method eliminates the aforementioned problem explained on page 1 in respect of traditional up-stand strips with pre-applied butyl and foam adhesives preventing the strip fully extending into the corner because their length is restricted by the rounded corners of the shower tray perimeter side wall 99 onto which they are firstly adhered.

To build on the aforementioned advantage, the sealant adhesive 51 extruded into the joint accommodates the extended joint width created by the rounded corners of shower trays and other joint width variations created by surrounding shower wall misalignments. Furthermore, problems explained in respect of sealant incompatibility with butyl adhesive and elastomeric materials are totally eliminated.

When the strip 11, sealant adhesive 50 and 53 and backing materials 40, 41 42, and 43, are supplied as a loose assembly in a kit, the installation components can be dimensionally varied to accommodate the particular site requirements and tailored to address variable joint widths, rounded shower tray perimeter corners, joint flexibility and acoustic considerations. The installer effectively designs the joint seal best suited to their requirements. Installing the strip, backing material and sealant adhesive in individual tasks eases the installation process and allows the installer to focus on installing each component perfectly which accumulatively delivers a superior installation.

The aforementioned disclosures are equally relevant to FIGS. 4-18 which present various embodiments of this invention.

Figure 5:
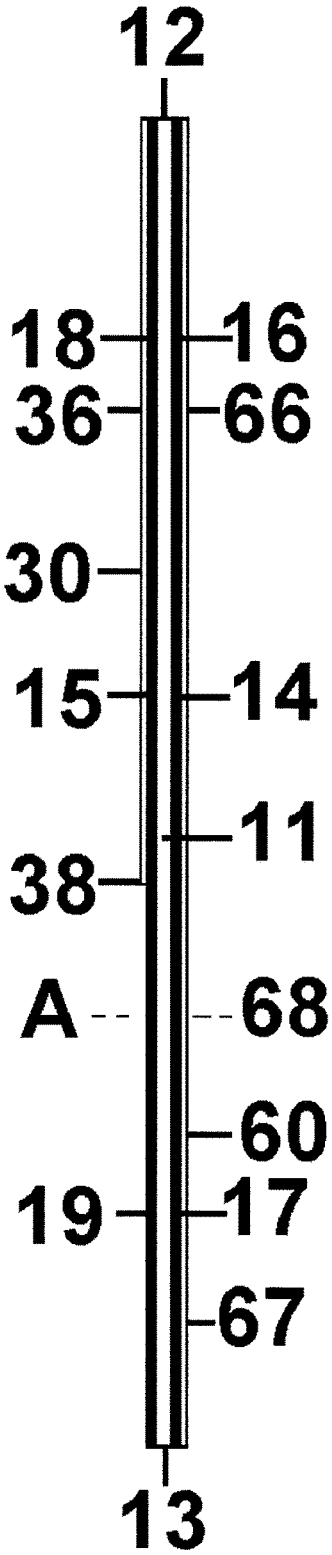
FIG. 5 represents a section view of FIG. 4, but in an upright position in an installed orientation.

FIGS. 4 and 5 of the drawings are similar to FIGS. 1 and 2 respectively with the exception that laminate film 30 is restricted to extend longitudinally over the strip outer face upper region 18 and not the whole outer face 15.

Figure 6:
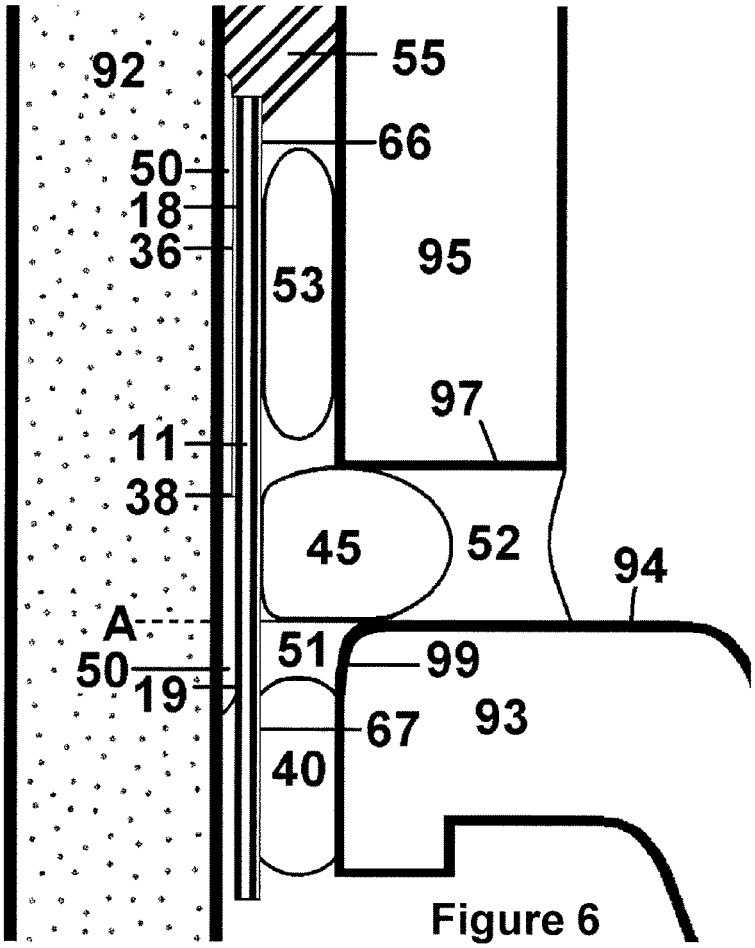
FIG. 6 represents a section view of the current invention as detailed in FIG. 5, after installation between a shower tray 93 and adjacent tiled 95 wall 92.

FIG. 6 drawing details features similar to FIG. 3 with the omission of the sealant backing material 43. Furthermore, the laminate film 36 covering the strip outside face upper region 18 extends from its upper boundary 31 down to its lower boundary 38. In this embodiment that part of the strip outer face located below the laminate film lower boundary 38 cannot form a bond with the adjacent sealant adhesive 50.

This is advantageous because under the effects of joint movement between the wall 92 and the perimeter side wall of the shower tray 99 wherein the joint expands and the adhesive sealant 51 comes under tension, this build up of tension can be released through the adjacent strip outer face lower region 19 not laminated with film 30, de-bonding off the sealant adhesive 50.

FIGS. 7 and 8 of the drawings disclose a strip 11 wherein the respective inner and outer face upper regions 16 and 18 are laminated with hydrophobic non-woven fleeces 70 and 80 through the provision of adhesive glue beds 91 and 90. A laminate film 67 extends longitudinally over the strip inner face lower region 17. The laminate fleece is rough in texture to create a mechanical engagement with tile adhesive 55.

Not shown in FIG. 7 or 9 but shown in FIG. 8 are isolating membranes 98 the first extending longitudinally on the strip inner face 14 adjacently above and along fleece face lower boundary 72 and the second extending longitudinally adjacently below and along fleece face lower boundary 72 on the opposite strip face 15.

The isolating membranes 98 are bonded to the strip 11 with pressure sensitive glues 96. Installers vary in expertise and one or more of these isolating membranes 98 may be bonded onto parts of the strip 11 to prevent reactive sealants making direct contact with the strip surfaces such as in the event that the backing materials 41/42 are omitted from the installation exposing the adjacent strip face to reactive sealants, or if reactive sealants are used to bond the strip outer face lower region 19 to the wall.

In this scenario, the ledge line 68 would defer to an alternate ledge line represented by the bottom edge of the isolating membrane 98 being in this drawing the same line as the fleece face lower boundary 72. The position of this sealant isolating membrane 98 on the strip inner face 14 may vary to accommodate the intended position of the strip 11 on the wall.

The general location of isolating membranes 98 shown in section FIG. 8 on the inner face 14 and outer face 15 are advantageous for purposes other than exclusively preventing reactive sealants making direct contact with the strip surfaces as disclosed.

The isolating membranes 98 are bonded to the strip 11 with pressure sensitive glues 96, but may also be releasable off same glues 96 because their glue engaging faces are siliconized allowing them to perform as adhesive release liners 96. Removal of isolating membranes 98 thus exposes these pressure sensitive glues 96 as adhesive beds or adhesive strips bonded to the strip 11. The isolating membranes 98 are in effect adhesive transfer tapes pre-applied on the strip during the manufacturing process.

FIG. 3 discloses a close celled backing material 43 bonded to the strip inner face 14 through adhesive bed 46. This backer material 43 shutters the tile adhesive 55 in the process fixing the position of its lower most boundary. Many installers do not apply sealant 53 as soakage preventing means preferring instead to rely on the void as an anti-capillary cavity. In this scenario, close celled backer material 43 is also advantageous in preventing moisture soakage into the tile adhesive if sealant 52 leaks.

Where the above backer material 43 in FIG. 3 is not supplied pre-laminated with an adhesive bed, removal of siliconized isolating membrane 98 off the strip inner face 14 in FIG. 8 exposes glue 96 to which such a backer material may be bonded as a alternative to a backer cord being supplied pre-laminated with an adhesive bed.

Using the isolating membrane 89 and glue 96 in this capacity, FIG. 8 would could be adapted (not shown) so the isolating membrane 98 and glue 96 on strip inner face 14 is positioned adjacently to the isolating membrane 98 bonded to the strip outer face 15 and the laminated film lower region 67 is be reduced in height to extend from the ledge line 68 down to the strip lower boundary 13.

Not also shown, but clearly within the scope of this invention is the longitudinal location of isolating membrane 98 and pressure sensitive glue 98 in the form of an adhesive transfer tape over a portion of laminated films 60 or 67 in which circumstances the isolating membrane 98 together with pressure sensitive glue 98 would be wholly releasable off the strip 11 portion to which attached.

Where such an isolating membrane 98 with pressure sensitive glue 98 is releasably bonded to a portion of laminated film 67 located below the perforated trimming line 69, and the strip is longitudinally partitioned along the perforated trimming line 69, the isolating membrane 98 and pressure sensitive glue 98 would remain releasably bonded to the adjacent partitioned waste portion of strip 11, in which case (referring to FIG. 3) it may be used by the installer to bond backer material 40 to the tray perimeter side wall 99 before locating the shower tray 93 against the strip inner face lower region 17.

Figure 16:
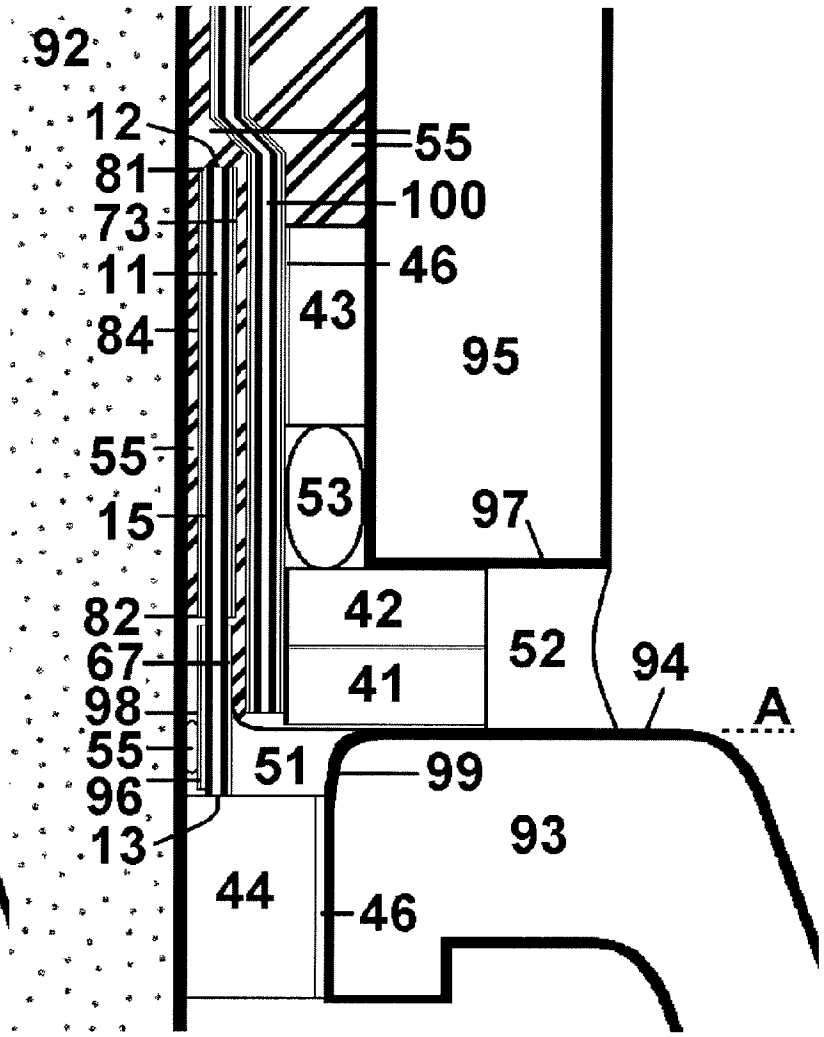
FIG. 16 represents a section view of the current invention after installation of the strip 11 between a shower tray 93 and adjacent tiled wall 92 and wherein the strip is installed above backing material 44.

An option disclosed in FIG. 16 description in respect of holding the strip in position on the wall, is that a longitudinal adhesive strip could be pre-applied onto the strip 11. In this scenario referring to FIG. 8, removal of isolating membrane 98 off the strip outer face 15 exposes glue 96 being an adhesive strip with which the strip 11 may be held in position on the wall.

FIG. 9 details those features shown in FIG. 8 (with the exception of the sealant isolating membrane 98) after installation between a shower tray 93 and adjacent wall 92. The strip 11 is overlapped by another fleeced waterproof wall membrane 100. In this embodiment we have bonded the fleece face 84 of the strip outer face upper region 18 to the wall with tile adhesive 55. It would also be appropriate to bond this fleece face 84 to the wall 92 with a sealant adhesive 50.

This fleece laminate 70 covering the strip inner face upper region 18 is to be preferred where it is intended to integrate the strip with a laminated fleeced waterproof system as shown or an alternative liquid applied waterproofing system. It would also be appropriate to bond this fleece face 70 to the adjacent fleeced membrane 100 with a sealant adhesive.

Figure 10:
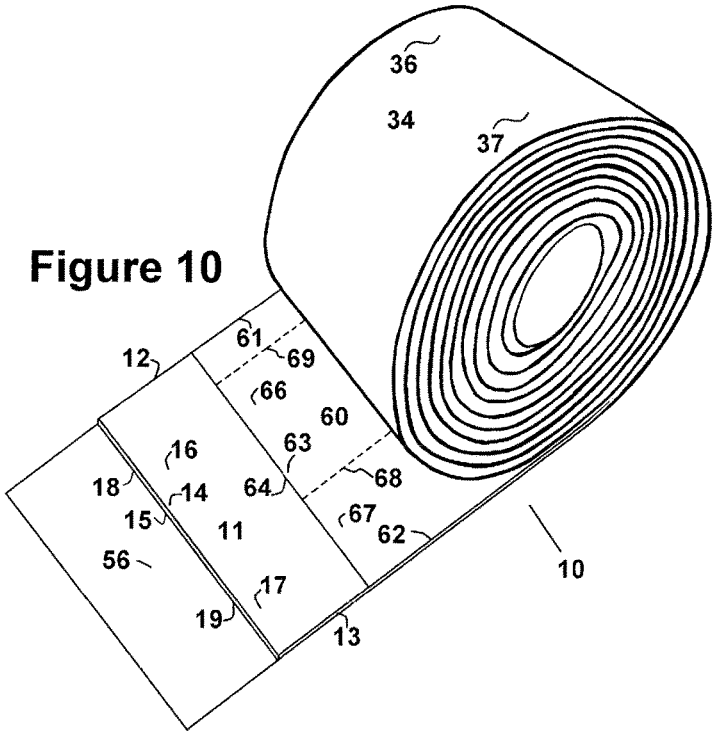
FIG. 10 represents a perspective peel back view of the current invention 10 in roll form, detailing strip 11 wholly laminated with film 60 on side 14 and wholly layered with an adhesive material 56 on side 15.
Figure 11:
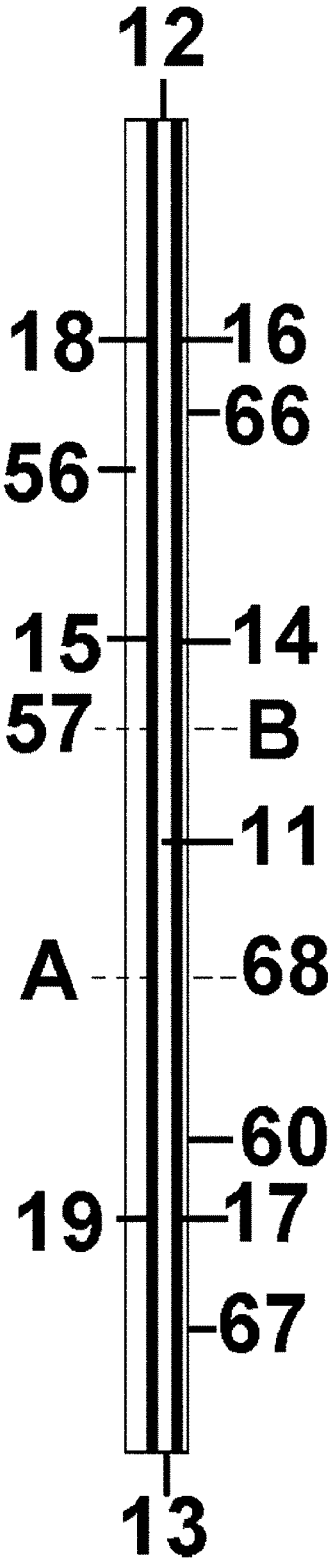
FIG. 11 represents a section view of FIG. 10 but in an upright position in an installed orientation.

FIGS. 10 and 11 of the drawings are similar to FIGS. 1 and 2 respectively with the exception that the laminate film on the strip outer face 15 is replaced by adhesive bed 56. While laminate film 60 on the strip inner face 14 ensures a tenacious bond with sealant adhesives 51 and 53, it also acts as an adhesive release liner for tacky preformed adhesive 56. Thus, this embodiment of the invention can be rolled up for transport and unrolled for direct installation onto the wall 92.

Figure 12:
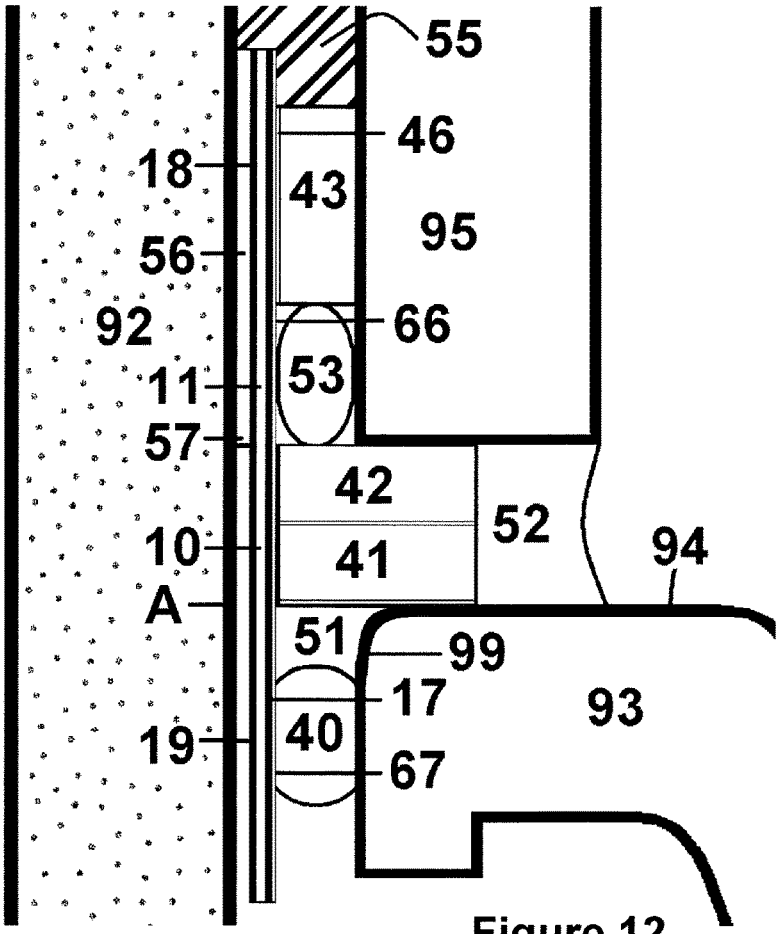
FIG. 12 represents a section view of the current invention as detailed in FIG. 11, after installation between a shower tray 93 and adjacent tiled wall 92 and wherein strip 11 is overlapped by waterproof wall membrane 101.

FIG. 12 details those features shown in FIG. 11 after installation between a shower tray 93 and adjacent wall 92 but wherein the adhesive bed 56 is reduced to a width defined by its lower boundary 57. This reduced width allows sealant 51 greater movement possibilities in the event of joint expansion as previously explained in respect of FIG. 6.

FIGS. 13 and 14 of the drawings disclose a strip 11 wherein a laminated film 67 extends over the strip inner face lower region 17 and a laminated film 36 extends over the strip outer face upper region 18.

FIG. 15 details those features shown in FIG. 14 after installation between a shower tray 93 and adjacent wall 92. Strip 11 is overlapped by 'stick on' fleeced waterproof wall membrane 101. In this embodiment the strip inner face upper region 16 is not laminated with film 60 so it may provide a good surface onto which the pressure sensitive adhesive 102 face of the overlapping waterproofing membrane 101 may be bonded.

FIG. 16 details many features shown in FIG. 9 but differs in that the strip lower boundary 13 rests on the backing material 44 and a sealant isolating membrane 98 extends longitudinally adjacent to the outer face lower boundary 13.

In this installation detail the plumber simply applies backing material 44 to the perimeter side wall 99 of the shower tray 93 and installs the shower tray 93 leaving the required gap between the wall 92 and perimeter side wall 99. The backing material acts as an acoustic insulator and sealant backing material. The tile installer positions the strip 11 on the backing material 44 and tight to the wall 92. The installer may elect to apply a skin of adhesive sealant 55 onto the wall adjacent to the backing material 44 to hold the strip in position.

Alternatively a longitudinal adhesive strip in the form of glue 96 covered with a siliconized isolating membrane 98 could be pre-applied onto the strip 11 adjacent to the outer face lower boundary 13 for the same purpose. The removal of isolating membrane 98 off the strip outer face 15 exposes glue 96 with which the strip may be held in position on the wall to provide a preliminarily means of part engagement of the strip 11 with the wall 92 in preparation for the subsequent application of a permanent adhesive beds 50 or 55 to facilitate a permanent engagement of the opposing strip outer face 15 or desired part thereof with the wall 92.

Figure 17:
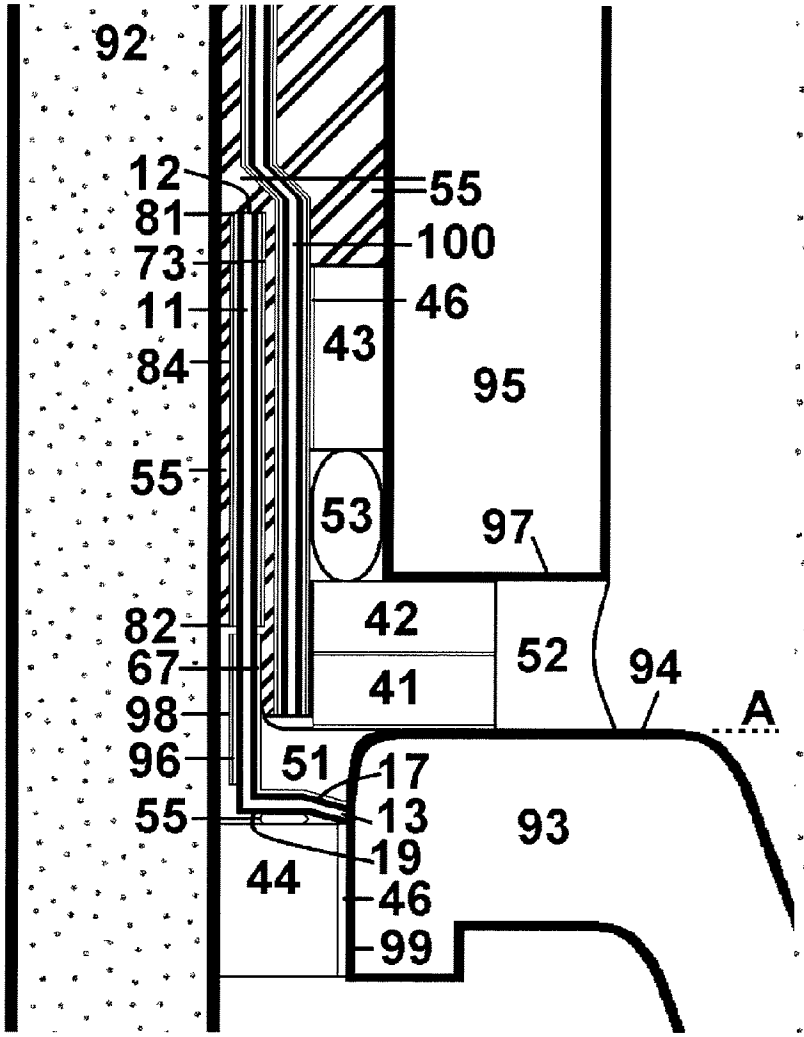
FIG. 17 represents a section view of the current invention after installation of the strip 11 between a shower tray 93 and adjacent tiled wall 92 and wherein the strip is installed to extend out over and upon backing material 44.

FIG. 17 details many features shown in FIG. 16 but differs in that the strip outer face lower region 19 extends out over the backing material 44 and the strip lower boundary 12 engages the perimeter side wall 99. This increases the interface between the strip inner face lower region 17 and the sealant adhesive 51 enhancing a watertight seal. The installer may elect to apply a skin of adhesive sealant 55 onto backing material 44 to hold the strip in position. Alternatively a longitudinal adhesive strip could be pre-applied onto the strip adjacent to the outer face lower boundary 13 for the same purpose.

Figure 18:
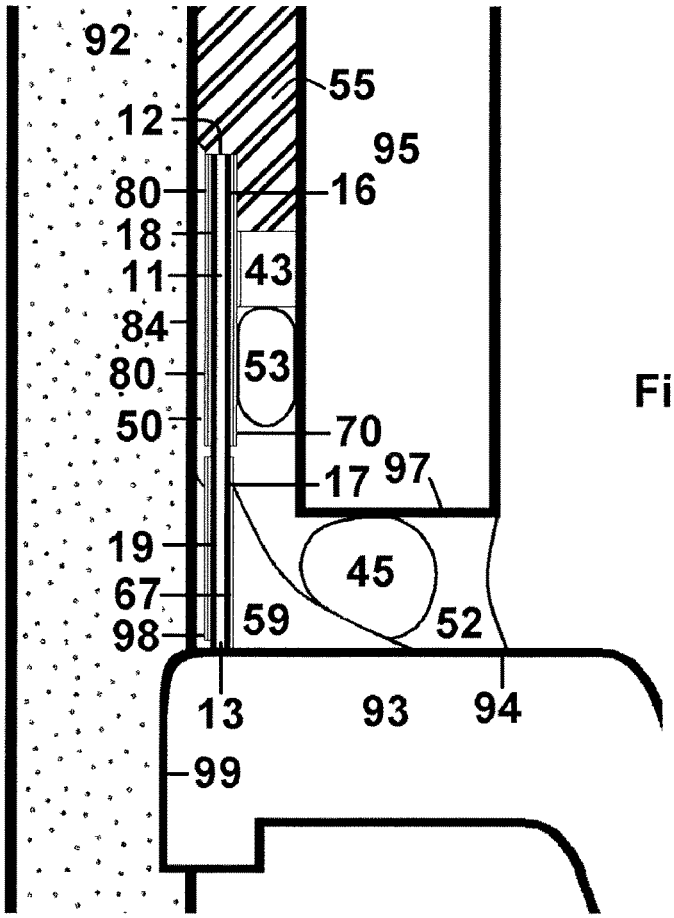
FIG. 18 represents a section view of the current invention after installation of the strip 11 over a shower tray ledge 94 recessed into wall 92 wherein the strip is installed to engage a fillet of sealant 59.

FIG. 18 details an installation wherein there is no gap between the wall 92 and shower tray perimeter side wall 99. As in FIGS. 16 and 17, the strip inner face upper region 16 and outer face upper region 18 are laminated with non-woven fleece layers 70 and 80 respectively. The strip inner face lower region 17 has a laminated film 67 and outer face lower region 19 is engaged with a sealant isolating membrane 98.

The strip is bonded to the wall 92 with sealant adhesive 50. Alternatively an adhesive bed pre-applied on the strip such as that means disclosed in FIG. 12 could bond it to the wall 92. Sealant adhesive fillet 59 provided a bond between the ledge and strip inner face lower region 17. If joint movement occurs the sealant fillet 59 remains bonded to the ledge and the tension created is accommodated through flexibility in attached strip.

To install in accordance with FIG. 18, the strip is located on the ledge 94 and bonded tight against the wall. The ledge is cleaned with alcohol and sealant adhesive 59 is fillet applied to engage the ledge 94 and adjacent strip inner face lower region 17.

Figure 19:
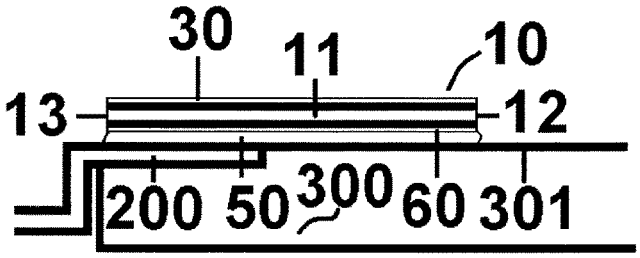
FIGS. 19, 20 and 21 represents section views of the current invention 10 in various embodiments extended horizontally to bridge the joint between a shower drain flange 200 and adjacent floor 300 upper surface 301.
Figure 20:
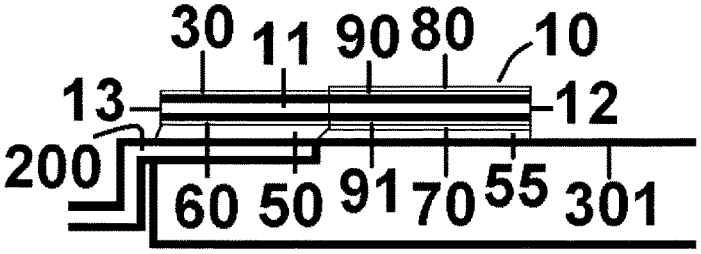
Figure 21:
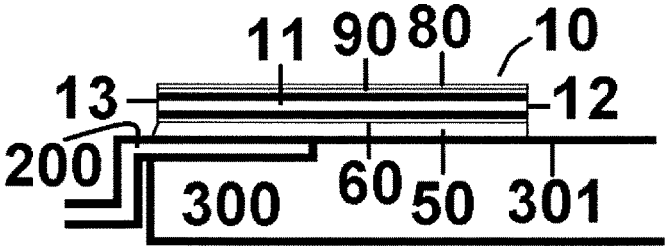

Unlike the preceding FIGS. 1-18, in FIGS. 19-21 section drawings the strip is adapted for installation in a substantially horizontal orientation to seal and bridge horizontal surfaces such as the flange of a shower drain to adjacent floor surfaces. In the following descriptions the term 'upper face' should be understood to define a material surface facing upward after installation and the term 'lower face' should be understood to define a surface material facing downward after installation.

FIG. 19 is a section drawing disclosing a shower base drain flange 200 recessed into floor 300 level with the floor upper face 301. The upper and lower faces of the strip 11 are laminated with films 30 and 60 respectively. Sealant adhesive 50 bonds the strip lower face to the drain flange 200 and floor upper face 301.

The strip upper face is intended to form a waterproof bond with complimentary waterproof membrane through the application of an adhesive sealant.

FIG. 20 discloses a shower base drain flange 200 recessed into floor 300 level with the floor upper face 301 similar to FIG. 19 but wherein strips of hydrophobic non-woven fleece 80 and 70 are laminated onto the strip 11 upper and lower faces through the provision of adhesive beds 90 and 91 respectively. Laminate films 30 and 60 extend longitudinally over those upper and lower surfaces of the strip 11 respectively not laminated with fleece. Sealant adhesive 50 bonds laminated film 60 to the drain flange 200 and tile adhesive 55 bonds the adjacent laminated fleece 70 to the floor upper face 301.

The strip upper face is intended to form a waterproof bond with complimentary waterproof membrane through the application of an adhesive sealant on the strip upper face laminate film 30 and sealant/tile adhesive on the laminate fleece 80.

FIG. 21 discloses a shower base drain flange 200 recessed into floor 300 level with the floor upper face 301 similar to FIG. 19 but wherein a hydrophobic non-woven fleece 80 is laminated onto the whole of the strip upper face through the provision of adhesive bed 90. Sealant adhesive 50 bonds the strip lower face to the drain flange 200 and floor upper face 301.

The strip upper face is intended to form a waterproof bond with complimentary waterproof membrane through the application of sealant/tile adhesive on the laminate fleece 80.

There are many embodiments possible within the scope of this invention in respect of positioning the laminated film 30, 60, the laminated fleece 70, 80, and where not to laminate the strip at all. It is intended that a multipurpose strip may be present to the installer that will accommodate a range of installation requirements such as installation before or after a shower tray is installed, installation behind the perimeter side wall 99 or over the ledge 94, bonding the strip 11 to the wall or adjacent waterproofing membranes with sealant adhesive 50 or tile adhesive 55.

The figures herein disclose just some of the embodiments but other embodiments not shown are possible within the scope of this invention such as the provision of two individual laminated films on a strip face or the provision of lines on the strip to used as a guide to longitudinally fold the strip onto itself wherein the strip becomes two connected strip layers each layer adapted to engage separate, opposing and adjacent joint substrates and provide gusset type flexibility.

Gusset type flexibility could take the form of a longitudinal pleat being two folds pressed into the strip during manufacture and retained in the strip through the provision of deformable or low tack adhesives such as butyl or hot melt adhesives. Such a pleat could be located in strip 11 adjacent to backer materials 41 and 42 in FIG. 3.

Consequentially, if the shower tray or bath 93 drops down, the sealant 51 pulls the connected strip inner face lower region 17 down with it. Because the pleat retaining adhesive materials are deformable or low tack, they can accommodate differential slippage between opposing fold surfaces to which they are attached allowing relatively stress free transverse elongation of strip 11 as the shower tray or bath 93 drops down.

It should be understood that the application of this invention is not exclusively related to sealing interior ledge/wall joints around shower trays and baths as the strip embodiments form a waterproof membrane relevant to waterproofing tiled floors, walls and shower wall panels and exterior waterproofing under floors, building strictures and infrastructure expansion joints.

The invention claimed is:

1. A sealing system including in combination an adhesive and a sealing member adapted to be installed to create a watertight barrier over substrates exposed to moisture in a shower environment and maintain a waterproof joint seal connection between two or more such substrates disposed in line or at an angle to each other, in an installed orientation without creating a triangular void comprising:

a flexible longitudinal strip having a strip upper boundary and a strip lower boundary between which strip boundaries there extends a strip inner face and a strip outer face which strip outer face has a strip outer face upper region and a strip outer face lower region and which strip inner face has a strip inner face upper region and a strip inner face lower region:

characterized in that the strip is wholly or partially etched to provide a tenacious engagement between the strip and the adhesive, wherein the adhesive is an uncured sealant adhesive material and is extrudable uncured from a tube and applied as desired and thereafter cured as a bonding material or a joint sealing material or both and the strip is installed as a separate component of the sealing system to extend fully without restriction into and around any 90 degree wall corner junctions and performs in combination with the uncured sealant adhesive material.

2. The sealing system as claimed in claim 1, wherein the strip is a flexible polymeric material.

3. The sealing system as claimed in claim 2, wherein the flexible polymeric material is polyethylene or polypropylene.

4. The sealing system as claimed in claim 1, wherein tenacious engagement between the strip and the adhesive material is achieved through plasma/corona etching of a part or a whole surface of the strip.

5. The sealing system as claimed in claim 1, wherein one or more parts of the strip are both etched and laminated with a silicone film.

6. The sealing system as claimed in claim 5, wherein the adhesive material is silicone based and tenaciously bondable to the silicone film.

7. The sealing system as claimed in claim 5, wherein the one or more parts of the strip laminated with the silicone film are highlighted using a dye or dyelines onto or into said one or more parts.

8. The sealing system as claimed in claim 5, wherein the silicone film extends over the entire strip inner face or over the entire strip outer face or over both faces simultaneously.

9. The sealing system as claimed in claim 8, wherein the silicone film extends in one or more longitudinal strips over the strip inner face or over the strip outer face or over both faces simultaneously.

10. The sealing system as claimed in claim 1, wherein one or more strip ledge lines extend longitudinally parallel on the strip.

11. The sealing system as claimed in claim 1, wherein one or more strip trimming lines or folding lines extend longitudinally parallel on the strip.

12. The sealing system as claimed in claim 11, wherein said one or more strip trimming lines or folding lines are perforated or are formed with a material weakness that would accommodate partitioning the strip by way of tearing.

13. The sealing system as claimed in claim 1, wherein the strip is partially laminated with fleece through use of a glue bed to provide non-releasable engagement between the strip and the fleece and a non-releasable engagement between the strip and a tile adhesive.

14. The sealing system as claimed in claim 13, wherein the fleece extends in one or more longitudinal strips over the strip inner face or over the strip outer face or over both faces simultaneously.

15. The sealing system as claimed in claim 14, wherein a laminated film extends longitudinally over the strip inner face lower region and the fleece extends over the strip inner face upper region and over the strip outer face upper region.

16. The sealing system as claimed in claim 1, wherein an isolating membrane is pre-applied to extend longitudinally on the strip by way of pressure sensitive glue.

17. The sealing system as claimed in claim 16, wherein the isolating membrane is a sealant isolating membrane that is pre-applied to extend longitudinally on the strip.

18. The sealing system as claimed in claim 17, wherein said isolating membrane extends longitudinally on the strip outer face and said isolating membrane is siliconized and removable to expose an adjacent pressure sensitive glue to provide a preliminarily partial engagement of the strip outer face with the wall in preparation for the subsequent application of a permanent adhesive bed to facilitate a permanent engagement of the opposing strip outer face or desired part thereof with the wall.

19. The sealing system as claimed in claim 16, wherein the isolating membrane extends longitudinally on the strip inner face and said isolating membrane is siliconized and removable to expose adjacent pressure sensitive glue bonded to the strip to form an adhesive bed on which is bonded a backer material to fix the position of a wall tile adhesive lower most boundary to limit or prevent the effects of capillary action.

20. The sealing system as claimed in claim 16, wherein the isolating membrane is siliconized and together with adjacent pressure sensitive glue extends longitudinally over a portion of a laminated film in which circumstances the isolating membrane with attached pressure sensitive glue combines to form an adhesive transfer tape wholly releasable off the strip portion to which it is attached.

21. The sealing system as claimed in claim 16, wherein said isolating membrane with attached pressure sensitive glue combines to form an adhesive transfer tape longitudinally located between a perforated trimming line and the strip lower boundary.

22. The sealing system as claimed in claim 1, wherein the strip is layered with a high tack adhesive.

23. The sealing system as claimed in claim 1, wherein a high tack adhesive bonded to the strip outer face or parts thereof provides an engagement between strip outer face and the adjacent surface to which applied and which high tack adhesive may engage a strip inner face laminate film when said strip is rolled for transport and which high tack adhesive may readily release off the strip inner face laminate film when the strip is unrolled for installation.

24. The sealing system as claimed in claim 23, in combination with a flexible compressible acoustic insulating sealant backing material.

25. The sealing system as claimed in claim 24, wherein the backing material is a longitudinal circular strip.

26. The sealing system as claimed in claim 24, wherein the backing material is a longitudinal four sided strip wherein at least one side may be coated with a pressure sensitive adhesive and said backing material is supplied in roll format.

27. The sealing system as claimed in claim 1, wherein the strip is supplied with backing material pre-applied.

28. The sealing system as claimed in claim 1, wherein the strip is foldable longitudinally into connected strip layers, wherein each of the strip layers is adapted to engage separate, opposing and adjacent joint substrates and provide flexibility.

29. The sealing system as claimed in claim 28, wherein said flexibility is longitudinally provided by pleating to accommodate stress free transverse elongation of the strip after strip installation between a shower tray or bath ledge and adjacent tile bottom edge.

30. The sealing system as claimed in claim 1, wherein the joint seal connection is between a wall and an adjacent perimeter side wall/ledge of a shower tray or bath.

31. A sealing system including in combination an adhesive and a sealing member adapted to be installed to create a watertight barrier over substrates exposed to moisture in a shower environment and maintain a waterproof joint seal connection between two or more such substrates disposed in line or at an angle to each other, in an installed orientation without creating a triangular void comprising: a flexible longitudinal strip having a strip upper boundary and a strip lower boundary between which strip boundaries there extends a strip inner face and a strip outer face which strip outer face has a strip outer face upper region and a strip outer face lower region and which strip inner face has a strip inner face upper region and a strip inner face lower region: characterized in that a laminated film is coated onto a part or a whole surface of the strip to provide a tenacious engagement between the strip and the adhesive material, wherein the adhesive is an uncured sealant adhesive material that is extrudable uncured from a tube and applied as desired and thereafter cured as a bonding material or a joint sealing material or both and the strip is installed as a separate component of the sealing system to extend fully without restriction into and around any 90 degree wall corner junctions and performs in combination with the uncured sealant adhesive material, wherein the laminated film is a silicone based liquid coated and cured onto the part or the whole surface of the strip.

32. The sealing system as claimed in claim 31, wherein the laminated film also provides a releasable engagement with preformed high tack adhesive strips.

33. A sealing system including in combination an adhesive and a sealing member adapted to be installed to create a watertight barrier over substrates exposed to moisture in a shower environment and maintain a waterproof joint seal connection between two or more such substrates disposed in line or at an angle to each other, in an installed orientation, comprising:

a flexible longitudinal strip having a strip upper boundary and a strip lower boundary between which strip boundaries there extends a strip inner face and a strip outer face which strip outer face has a strip outer face upper region and a strip outer face lower region and which strip inner face has a strip inner face upper region and a strip inner face lower region:

characterized in that the strip is wholly or partially etched, a laminated film is coated onto a part or a whole surface of the strip, the laminated film is a silicone-based liquid and one or more parts of the strip are both etched and laminated with a silicone film, wherein the adhesive is an uncured sealant adhesive material which is extrudable uncured from a tube and applied as desired and thereafter cured as a bonding material or a joint sealing material or both and the strip is installed as a separate component of the sealing system and performs in combination with the uncured sealant adhesive material, and wherein the laminated film is a silicone based liquid coated onto a part or a whole surface of the strip to provide a tenacious engagement between the strip and the adhesive material.

* * * * *